US009338849B2

(12) United States Patent
Logiudice

(10) Patent No.: US 9,338,849 B2
(45) Date of Patent: May 10, 2016

(54) SPATIAL INTENSITY DISTRIBUTION CONTROLLED FLASH

(71) Applicant: Infineon Technologies Austria AG, Villach (AT)

(72) Inventor: Andrea Logiudice, Padua (IT)

(73) Assignee: Infineon Technologies Austria AG, Villach (AT)

( * ) Notice: Subject to any disclaimer, the term of this patent is extended or adjusted under 35 U.S.C. 154(b) by 543 days.

(21) Appl. No.: 13/757,884

(22) Filed: Feb. 4, 2013

(65) Prior Publication Data

US 2014/0217901 A1 Aug. 7, 2014

(51) Int. Cl.

| | |
|---|---|
| ***H05B 37/00*** | (2006.01) |
| ***H05B 39/00*** | (2006.01) |
| ***H05B 41/14*** | (2006.01) |
| ***H05B 33/08*** | (2006.01) |

(52) U.S. Cl.
CPC ..... *H05B 33/0854* (2013.01); *H05B 33/0845* (2013.01); *H05B 33/0848* (2013.01)

(58) Field of Classification Search
USPC ..... 315/149, 152, 151, 150, 153, 155, 158, 315/159
See application file for complete search history.

(56) References Cited

U.S. PATENT DOCUMENTS

| | | | | |
|---|---|---|---|---|
| 2007/0091602 | A1* | 4/2007 | van Voorst Vader et al. | 362/244 |
| 2009/0073275 | A1* | 3/2009 | Awazu | 348/222.1 |
| 2011/0019991 | A1 | 1/2011 | Lee et al. | |
| 2011/0123183 | A1 | 5/2011 | Adelsberger et al. | |
| 2012/0306410 | A1* | 12/2012 | Kono et al. | 315/362 |
| 2015/0035440 | A1* | 2/2015 | Spero | 315/153 |
| 2015/0181658 | A1 | 6/2015 | Logiudice et al. | |

OTHER PUBLICATIONS

More About the Relationship Between intensity and Distance; available at: imagine.gsfc.nasa.gov/YBA/M31-velocity/1overR2-more.html; accessed Jan. 18, 2013; last updated Jan. 30, 2006.

U.S. Appl. No. 14/835,491, by Andrea Logiudice et al., filed Aug. 25, 2015.

* cited by examiner

*Primary Examiner* — Anh Tran
(74) *Attorney, Agent, or Firm* — Shumaker & Sieffert, P.A.

(57) ABSTRACT

This disclosure describes techniques for outputting light with a controlled spatial intensity distribution. According to some examples, this disclosure describes a device that includes at least one LED matrix that includes a plurality of LED elements. According to these examples, the device controls the LED elements of the LED matrix to output the light by causing at least a first LED element of the LED matrix to output light of a first intensity, and causing a second LED element of the LED matrix to output light of a second, different intensity. In some examples, the device controls the first at least one LED element to output light of the first intensity to illuminate a first object, and controls the second LED element to output light of the second intensity to illuminate a second object. The second object may have a different location than the first object.

13 Claims, 7 Drawing Sheets

SPATIAL INTENSITY DISTRIBUTION CONTROLLED FLASH

TECHNICAL FIELD

This disclosure relates generally to techniques for illumination. More specifically, this disclosure is directed to techniques for illuminating one or more objects for purposes of image capture or other purposes.

BACKGROUND

In many cases, it may be desirable to illuminate one or more objects, such as for purposes of image capture with a camera device. In some examples, a camera device may include a flash, which may output light when a camera sensor of the camera device is operated to capture an image.

SUMMARY

This disclosure is directed to techniques for outputting light with a controlled spatial intensity distribution. In some examples, the light may be output by a camera device in order to illuminate objects while an image sensor of the camera device is operated to capture one or more images. According to some examples, a camera device may include a flash module that includes an LED matrix comprising a plurality of LED elements. To control the flash module, the camera device may cause at least a first LED element of the LED matrix to output light of a first intensity, and cause at least a second LED element of the LED matrix to output light of a second intensity different than the first intensity. The light output by the first at least one LED element may be used to illuminate a first object at a first position, while the light output by the second at least one LED element may be used to illuminate a second object at a second position different than the first position.

According to one example, a device is described herein. The device includes an LED matrix that includes a plurality of LED elements. The device further includes an LED control unit that determines a spatial intensity distribution of light to be output by an LED matrix comprising a plurality of LED elements and controls the LED matrix to output light with the determined spatial intensity distribution.

According to another example, a method is described herein. The method includes determining a spatial intensity distribution of light to be output by an LED matrix comprising a plurality of LED elements. The method further includes controlling the LED matrix to output light with the determined spatial intensity distribution.

According to another example, a device is described herein. The device includes means for determining a spatial intensity distribution of light to be output by an LED matrix comprising a plurality of LED elements. The device further includes means for controlling the LED matrix to output light with the determined spatial intensity distribution.

The details of one or more examples are set forth in the accompanying drawings and the description below. Other features, objects, and advantages of the invention will be apparent from the description and drawings, and from the claims.

DETAILED DESCRIPTION

Figure 1:
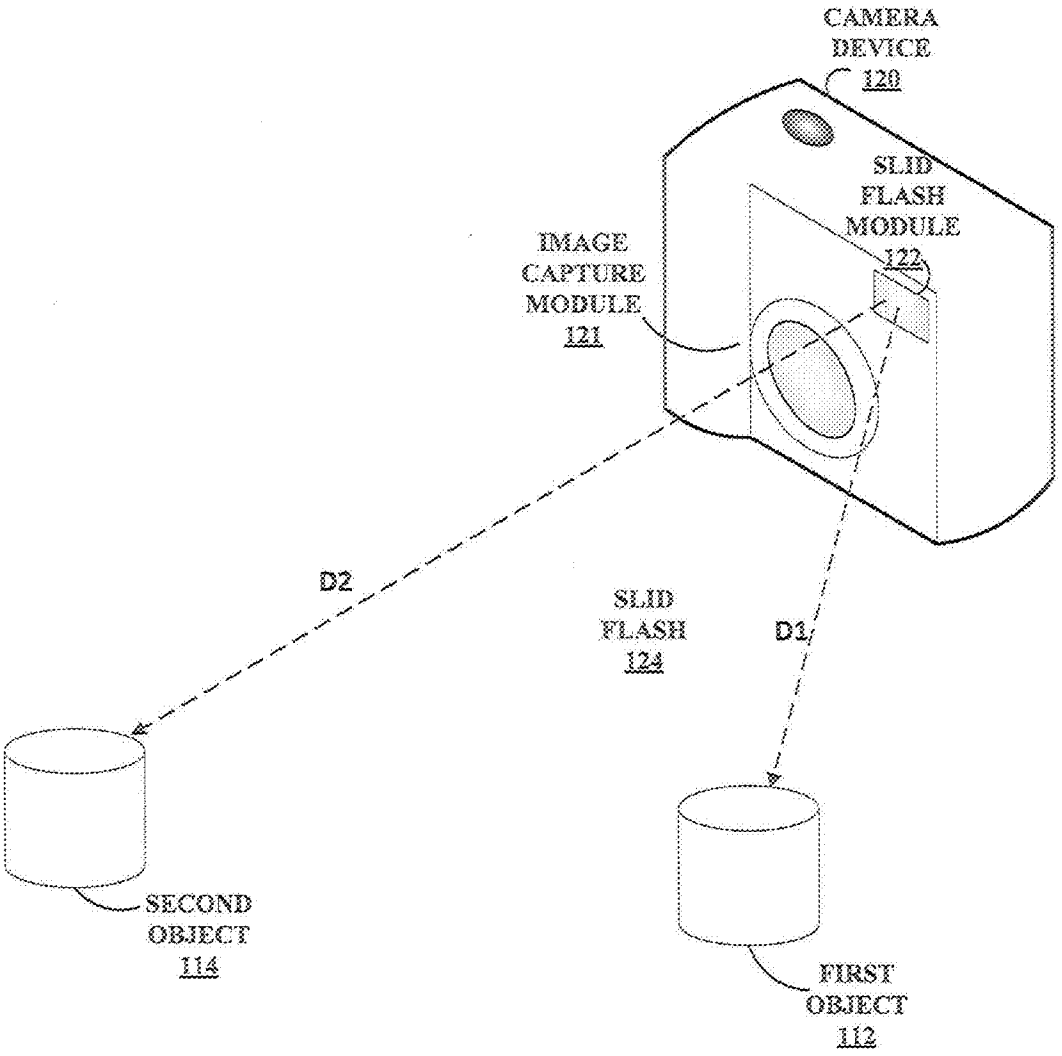
FIG. 1 is a conceptual diagram of a camera device that includes a spatial light intensity distribution (SLID) flash consistent with one or more aspects of this disclosure.

FIG. 1 is a conceptual diagram that illustrates one example of a camera device 120 that includes a spatial light intensity distribution (SLID) flash module 122 according to one or more aspects of this disclosure. Camera device 120 depicted in FIG. 1 is provided for exemplary purposes only, and is intended to be non-limiting. For example, although camera device 120 depicted in FIG. 1 comprises a device that is configured primarily for capturing images, camera device 120 may instead comprise any device other type of device that includes one or more components configured to capture images. For example, camera device 120 may comprise a mobile phone, a "smart phone," a tablet computer, a personal digital assistant (PDA), or any other portable device that includes or is coupled to one or more components configured to capture images. As other examples, camera device 120 may comprise any type of computing device such as a laptop computer, desktop computer, gaming console, or the like that includes or is coupled to one or more components configured to capture images.

As shown in FIG. 1, camera device 120 includes one or more image capture modules 121. Generally speaking, image capture module 121 is configured to, when activated, capture an image that represents an appearance of one or more physical objects in an environment of camera device 120, such as first object 112 or second object 114 depicted in FIG. 1. First object 112 and/or second object 114 may comprise any type of visible object, such as a human or animal subject, a building, an automobile, and tree, or the like.

In some circumstances, ambient light in an environment of camera device 120 may not be sufficient to capture a quality image of one or more objects 112, 114. Camera device 120 may include spatial light intensity distribution (SLID) flash module 122 for purposes of illuminating one or more objects 112, 114. SLID flash module 122 may output one or more substantially instantaneous bursts of light to illuminate one or more objects 112, 114 when image capture module 121 is operated to capture one or more images, in order to improve a quality of the one or more captured images that represent objects 112, 114.

In some examples, a typical camera device may be configured to adjust a level of illumination output via a flash module, such that the light output by the flash module is optimized to capture a quality image of an object. As one example, a camera device may determine a level of ambient illumination directed to an image capture module, and adjust an illumination level of light output by the flash module in light of the determined ambient illumination. For example, if the camera device determines that a level of ambient illumination directed to an image capture module is relatively low, the camera device may increase an illumination level of light output by the flash module.

As another example, a camera device may determine a distance between an image capture module and an object to be captured as an image. For example, such a camera device may capture a preliminary image, and process the preliminary image to determine a distance between the camera device and the object. In response to determining the distance, the camera device may modify an intensity of light output by a flash module of the camera device. For example, if the distance to an object to be captured as an image is further from the camera device, the camera device may increase the intensity of illumination output by the flash module, such that the object is sufficiently illuminated to capture an image of desirable quality. As another example, if the object to be captured as an image is closer to the camera device, the camera device may decrease the intensity of illumination output by the flash module, such that the object is not overly illuminated.

A typical camera device flash module may only adapt an intensity of light to improve illuminate one object. As such, a typical camera device flash module may not be capable of illuminating two objects at different locations (i.e., different distances) with respect to the camera device simultaneously, in order to capture an image of high quality that represents both objects.

This disclosure is directed to systems, devices, and methods that provide for improvements in illuminating objects for purposes of image capture, as well as for other purposes. For example, this disclosure describes a camera device 120 that includes an SLID flash module 122. The SLID flash module 122 may output light with a controlled spatial light intensity distribution.

The SLID flash module 122 may include an LED control module and an LED matrix that includes a plurality of LED elements. The LED matrix may comprise a monolithic LED matrix with a plurality of independent LED elements formed in the same substrate material (e.g., a semiconductor substrate). To control the spatial light intensity distribution of light output by the LED matrix, the LED control module may cause at least one LED element of the LED matrix to output light of a different intensity that at least one other LED element of the LED matrix.

In some examples, SLID flash module 122 may output light with the control spatial light intensity distribution in order to illuminate two or more objects at different locations (e.g., different distances) with respect to camera device 120. For example, as shown in FIG. 1, camera device 120 is arranged to capture an image of a first object 112 at a first location (e.g., a first distance D1) from camera device 120, as well as a second object 114 at a second location (e.g., a second distance D2) from camera device 120. As shown in FIG. 1, the second distance D2 is greater than the first distance D1.

SLID flash module 122 may illuminate both the first object 112 located the first distance D1 from the camera device 120 and the second object 114 located the second distance D2 from the camera device 120 substantially simultaneously. In order to do so, SLID flash module 122 may use a first at least one LED element of the LED matrix to illuminate first object 112, and use a second at least one LED element of the LED matrix to illuminate second object 114.

As one example, camera device 120 may identify the first object 112 and the second object, via image processing techniques (e.g., facial and/or object recognition software, user input). Camera device 120 may also determine a relative location of (e.g., distance to) the first object 112 and the second object 114. In one such example, camera device 120 may use image capture module 121 to capture one or more preliminary images of an environment that includes both the first and second objects. Camera device 120 may process the preliminary images and use the preliminary image to determine one or more values associated with the respective distances D1 and D2. In another example, camera device 120 may use one or more sensors to determine the one or more values associated with the respective distances D1 and D2. For example, camera device 120 may use one or more time of flight sensors that output light and determine a distance to an object based an amount of time for the light to reflect from the object and be detected by the sensor.

Once the one or more values associated with the respective distances have been determined, SLID flash module 122 may determine an illumination intensity for at least two LED elements of the LED matrix. For example, to illuminate the first and second objects 112 and 114 substantially simultaneously, SLID flash module 122 may determine a first illumination intensity for a first at least one LED element of the LED matrix to illuminate the first object 112 at the first distance D1, and determine a second, different illumination intensity for a second at least one LED element of the LED matrix to illuminate the second object 114 at the second distance D2. In this manner, camera device 120 may use the LED matrix to illuminate both the first object 112 and the second object 114 substantially simultaneously with operating image capture module 121 to capture an image in an optimized fashion, which may thereby improve a quality of a captured image comprising both the first and second objects 112, 114.

Figure 2:
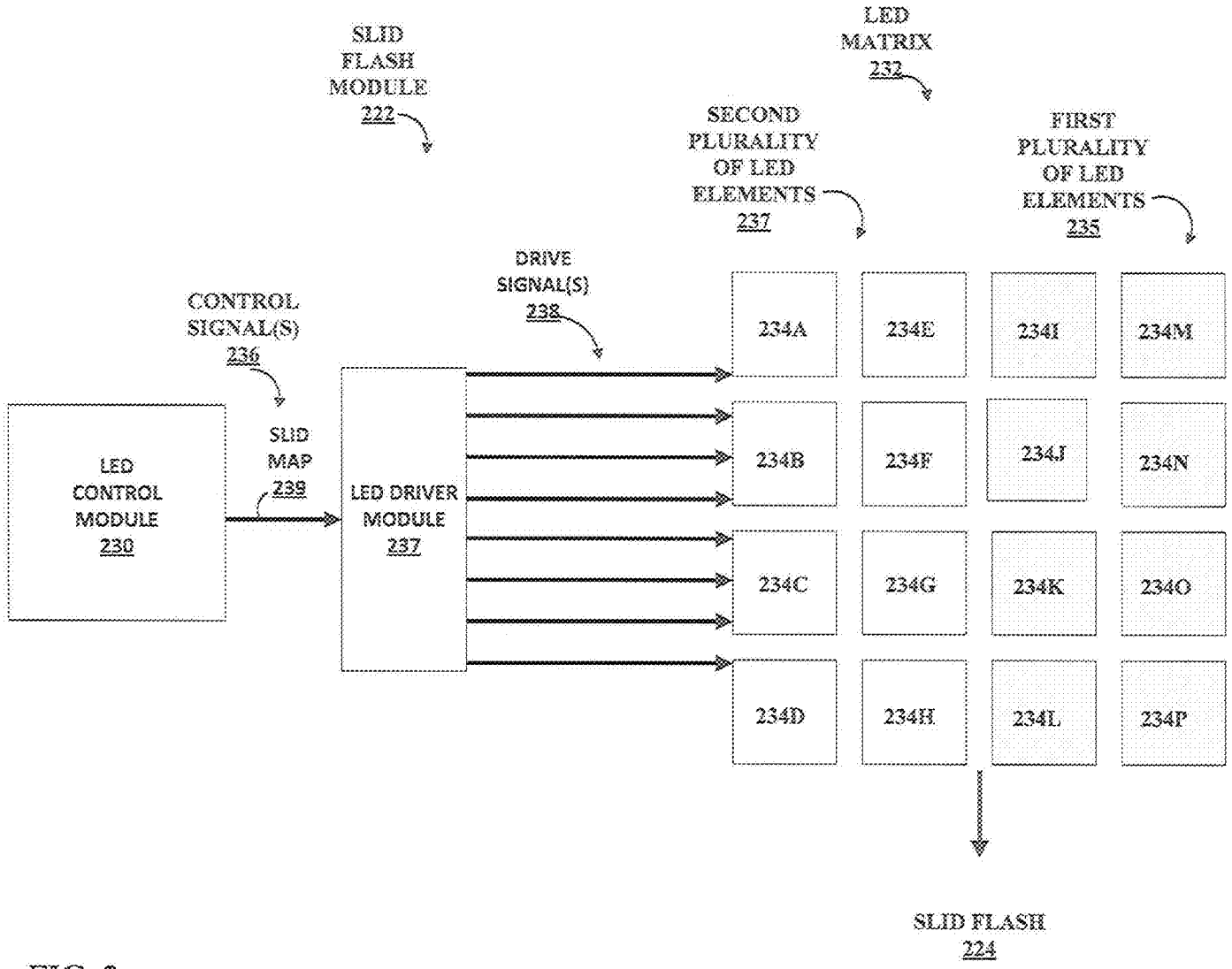
FIG. 2 is a block diagram that illustrates generally one example of an SLID flash module consistent with one or more aspects of this disclosure.

FIG. 2 is a block diagram that illustrates conceptually one example of an SLID flash module 222 consistent with one or more aspects of this disclosure. As shown in the example of FIG. 2, the SLID flash module 222 includes an LED matrix 232 comprising a plurality of LED elements 234A-234P, an LED control module 230, and an LED driver module 237. According to this example, LED control module 230 may control LED matrix 232 to a spatial light intensity distribution of light output by LED matrix 232.

For example, to do so, LED control module 230 may generate one or more control signals 236 to control the LED elements 234A-234P of the LED matrix. According to the techniques described herein, LED control module 230 may generate the one or more control signals such that at least one LED element 234A-234P of the LED matrix 232 outputs light of a different intensity than at least one other LED element 234A-234P of the LED matrix 232.

To control the LED elements 234A-234P, LED control module 236 may generate the one or more control signals, and output the one or more control signals to LED driver module 237. LED driver module 237 may be configured to, based on the one or more control signals, generate one or more drive signal(s) 238 with a current level selected to cause one or more of LED elements 234A-234P to output light with a desired intensity. In some examples, to generate the one or more drive signal(s) 238 with a current level consistent with a desired intensity, LED driver module 237 may generate a pulse width modulated (PWM) drive signal with a duty cycle consistent with the desired current level. For example, LED driver module 237 may generate a driver signal 238 with a 90 percent duty cycle, which may cause one or more LED elements to receive 90 percent of a maximum current level, and thereby output light with an intensity level of 90 percent of a maximum intensity level of the LED element. As another example, LED driver module 237 may generate a driver signal 238 with a fifty percent duty cycle, which may cause one or more LED elements to receive fifty percent of a maximum current level, and thereby output light with an intensity level of half of a maximum intensity level of the LED element.

In some examples, as shown in FIG. 2, LED control module 230 may generate a control signal 236 comprising a spatial light intensity distribution map (SLID map) 239. The SLID map 239 may indicate, for each LED element 234A-234P of the LED matrix 232, an intensity of light to be output by the respective LED element 234A-234P. As one specific example, the SLID map 239 may comprise a plurality of digital (e.g., binary) values that indicate an intensity value for each LED element 234A-234P of the LED matrix 232. LED driver module 237 may receive and interpret the plurality of digital values that indicate intensity values, and generate an electrical signal with a current level (e.g., a duty cycle) to drive the respective LED elements 234A-234P to output light with the indicated intensity value. In this manner, as shown in FIG. 2, LED control module 230 may control the LED elements 234A-234P of LED matrix 232 to output a spatial intensity distribution controlled flash 224.

According to the techniques of this disclosure, at least one intensity value of the SLID map 239 may be different than at least one other intensity value of the SLID map 239. Accordingly, LED driver module 237 may drive at least one LED element 234A-234P of LED matrix 232 to output light of a first intensity, and at least one other LED element 234A-234P of LED matrix 232 to output light of a second, different intensity. For example, as indicated by shading (or lack of shading) in FIG. 2, a first plurality of LED elements 234A-234H do not include shading, which indicates that they are controlled by LED control module 230 to output light of a first intensity. As also shown 2, a second plurality of LED elements 234I-234P include shading, which indicates that they are controlled by LED control module 230 to output light of a second intensity different than the first intensity. In this manner, LED control module 230 may control LED matrix 232 to output a spatial intensity distributed flash 224. As described above with respect to FIG. 1, LED control module 230 may, in some examples, control LED matrix 232 to output the spatial intensity distribution controlled flash 224 in order to illuminate at least two different objects arranged at different locations (e.g., different distances), from LED matrix 232, which may improve a quality of one or more images including the at least two different objects. In other examples, LED control module 230 may control LED matrix 232 to output the spatial intensity distribution controlled flash 264 for one or more other purposes where illumination is desirable, such as for vehicle headlights (e.g., automobile, bicycles, motorcycles, boats, aircraft, or the like), or any other purpose.

Figure 3:
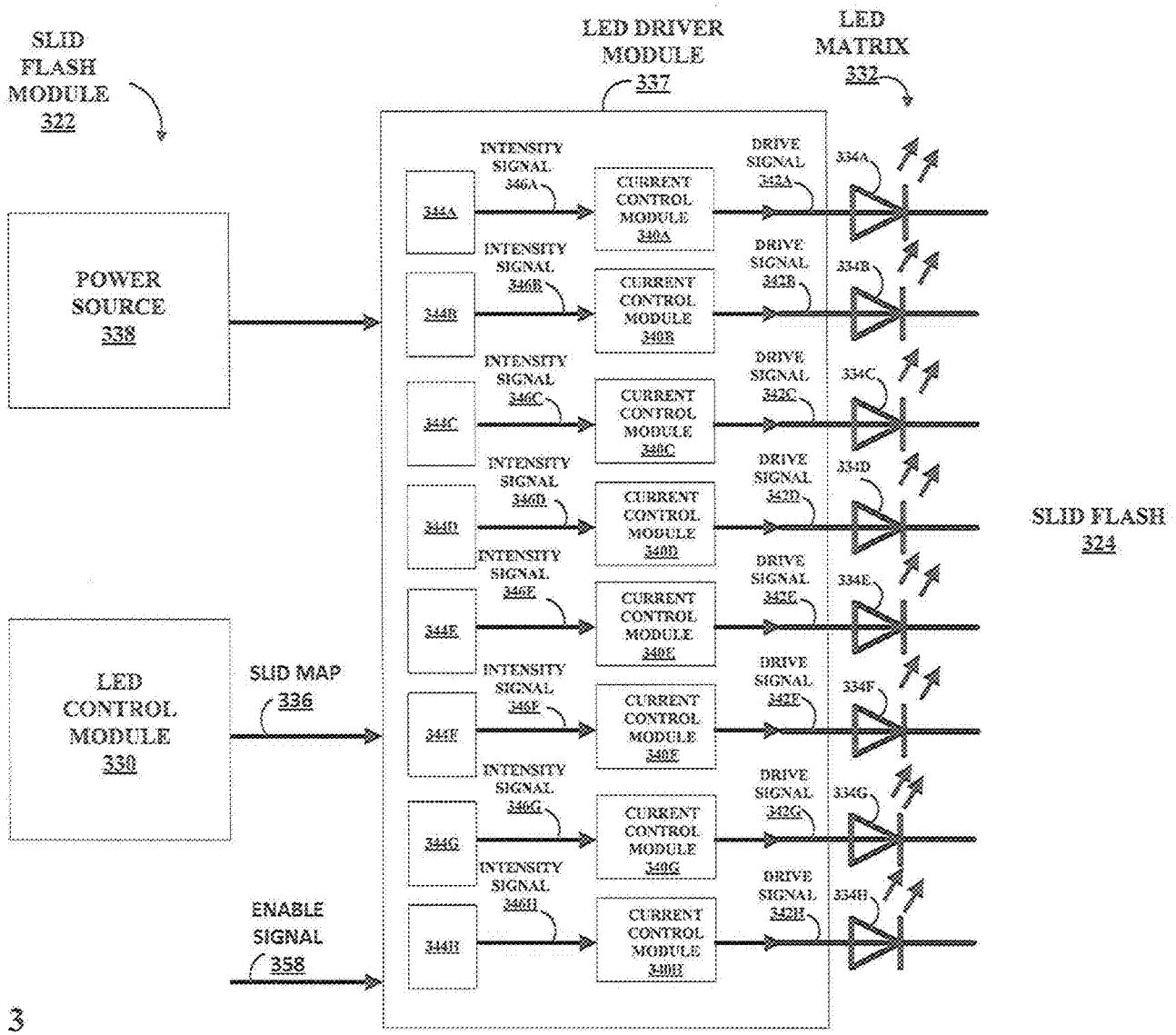
FIG. 3 is a conceptual diagram that illustrates generally one example of an SLID flash module consistent with one or more aspects of this disclosure.

FIG. 3 is a conceptual diagram that illustrates one example of an SLID flash module 322 consistent with one or more aspects of this disclosure. As shown in FIG. 3, the SLID flash module 322 includes a power source 338, an LED control unit 330, an LED driver module 337, and a plurality of LED elements 334A-334H. As shown in the example of FIG. 3, LED driver module 337 includes a plurality of memory elements 344A-335H and a plurality of current control modules 340A-340H. According to this example, each respective memory element 334A-344H and an associated current control module 340A-340H are associated with one of the respective LED elements 334A-334H. For example, memory element 344A and current control module 340A may, in combination, be used to drive LED element 344A, and memory element 344B and current control module 340B may, in combination, be used to drive LED element 344B.

According to the example of FIG. 3, in operation, LED control module 330 may generate an SLID map 336. The SLID map 336 may comprise a plurality of values that indicate an intensity level of light to be output by each respective LED element 334A-334H. According to this example, each of the respective values of the SLID map 336 may be stored in a respective memory element 344A-344H. As also shown in FIG. 3, LED drive module 337 may be configured to receive an enable signal 358 that indicates that LED driver module 337 should output each respective value stored in registers 344A-344H as an intensity signal 346A-346H to each respective current control module 340A-340H. For example, enable signal 358 may comprise, or be based on, a clock signal. According to this example, enable signal 358 may be generated a predetermined number of clock signals after SLID flash module 322 receives an indication that an associated image capture module (not shown in FIG. 3) is prepared to capture an image, such that SLID flash module 322 outputs light substantially simultaneously with operation of the image capture module to capture an image.

According to the example of FIG. 3, each respective memory element 344A-344H may output a respective intensity signal 346A-346H to a respective current control module 340A-340H. In response to receiving an intensity signal 346A-346H, each respective current control module 340A-340H may receive energy from power supply 338 and control at least one characteristic of energy supplied to each respective LED element 334A-334H based on a value of a received intensity signal 346A-346H. For example, current control modules 340A-340H may receive electrical energy from power source, and in response to a value of the respective intensity signal 346A-346H, generate a drive signal 342A-342H with a current level based on a received intensity signal 346A-346H. As one example, each respective drive signal 342A-342H may comprise a PWM drive signal with a duty cycle consistent with a value indicated by the received intensity signal 346A-346H. In this manner, each respective current control module 340A-340H may control an intensity of light emitted by an LED element 334A-334H, independent from an intensity of other LED elements 334A-334H of the LED matrix 332.

By independently controlling each LED element 334A-334H of an LED matrix 332, as shown in FIG. 3, SLID flash module 322 may output a spatial intensity distribution controlled flash 324. The spatial intensity distribution controlled flash 324 may include light output from one LED element of the LED matrix 332 that has an intensity level different than an intensity level of light output by at least one other LED element of the LED matrix 332.

SLID flash module 322 depicted in FIG. 3 is provided for exemplary purposes only, and is intended to be non-limiting. For example, LED driver module 337 depicts a plurality of LED elements 334A-334H that each is associated with an independent memory element 344A-344H that stores an intensity value received from LED control module 330, as well as independent current control module 340A-340H that drives the respective LED element 334A-334H. In this manner, each LED element 334A-334H is controllable independently of each other LED element 334A-334H to output light of a different intensity than every other LED element 334A-334H of the LED matrix 332. In other examples not depicted in FIG. 3, each of LED elements 334A-334H may not be independently controllable respective to all other LED elements 334A-334H of the LED matrix 332. In other examples, LED elements of one or more groupings of LED elements may be controllable to output light of a first intensity, while at least one other grouping of LED elements may be controllable to output light of a second, different intensity. As one example not depicted in FIG. 3, LED elements 334A-334D may be controllable together, and LED elements 334E-334H may be controllable together. For example, instead of each LED element having an associated memory element and an associated current control module, a first control module and a first memory element may in combination control LED elements 334A-334D, while a second current control module and a second memory element may in combination control LED elements 334E-334H. According to such examples, a first at least one LED element (e.g., comprising LED elements 334A-334D) may be controlled to output light of a first intensity, while a second at least one element (e.g., LED elements 334E-334H) may output light of a second, different intensity, thereby outputting, in combination, a spatial intensity distribution controlled flash 324.

LED control module 330 may use LED driver module 337 to generate a spatial intensity distribution controlled flash 324 as described above with respect to FIG. 3, in order to illuminate one or more objects for purposes of improving the capture of images by a camera device, such as camera device 120 depicted in FIG. 1. For example, LED control module 330 may use LED driver module 337 to cause at least one LED element LED element 334A-334H of an LED matrix 332 to output light of a different intensity than at least one other LED element 334A-334H of the LED matrix 332, in order to illuminate two or more objects located at different distances from one another, which may thereby improve a quality of image capture by a camera device. In other example, SLID flash module 332 may be used for other illumination purposes consistent with one or more aspects of this disclosure. For example, SLID flash module 332 may be used to improve illumination performance of any device configured to illuminate an object for any purpose.

Figure 4:
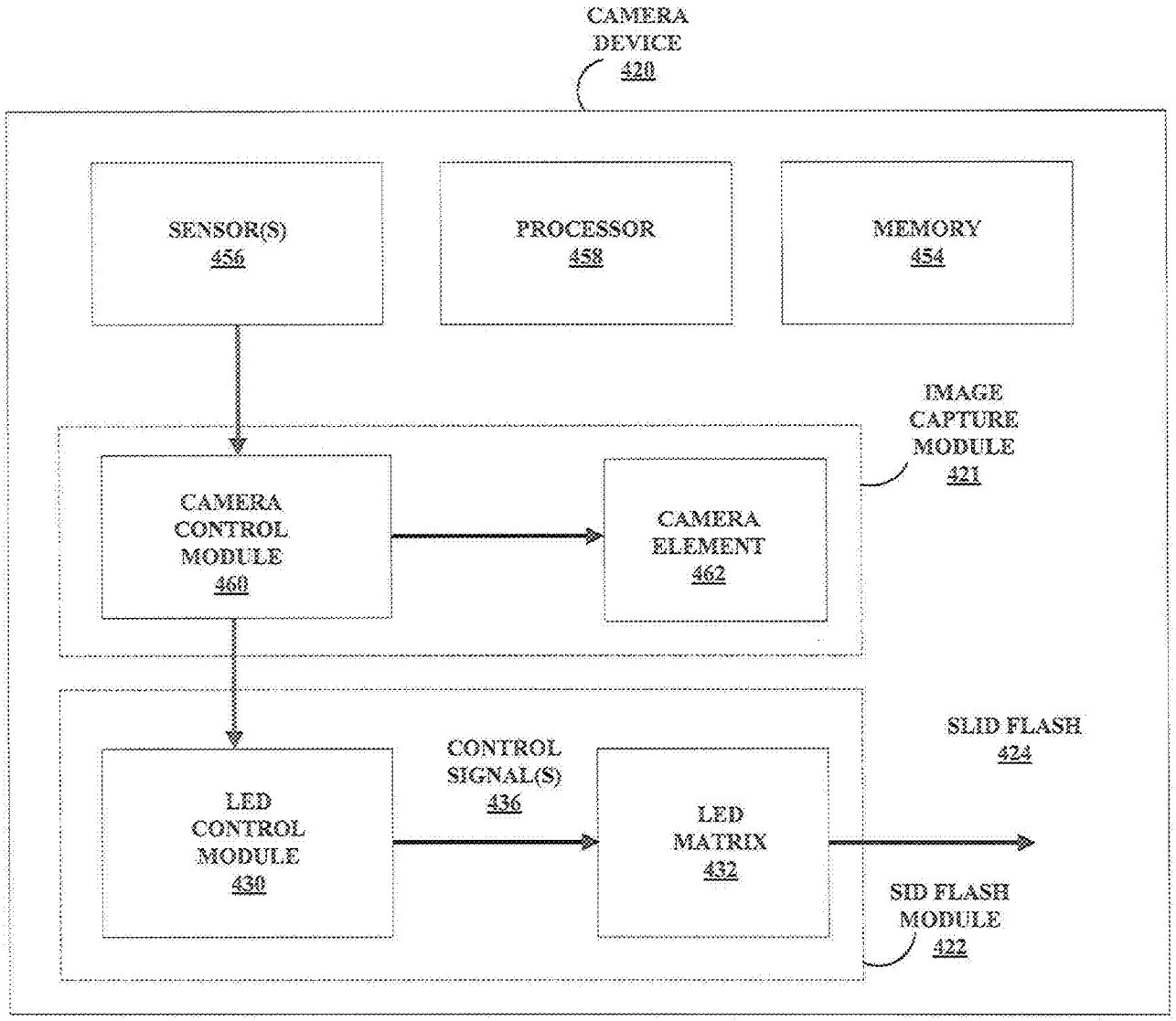
FIG. 4 is a block diagram that illustrates generally one example of a camera device configured to output light with a controlled spatial intensity distribution consistent with one or more aspects of this disclosure.

FIG. 4 is a block diagram that illustrates conceptually a camera device 420 that includes an SLID flash module consistent with one or more aspects of this disclosure. As shown in FIG. 4, camera device includes an image capture module 421 and SLID flash module 422. Camera device 420 may comprise a device that is adapted primarily to capturing images such as a video or still image camera device. In other examples, camera device 420 may instead comprise any device other type of device that includes one or more components configured to capture images. For example, camera device 420 may comprise a mobile phone, a "smart phone," a tablet computer, a personal digital assistant, or any other portable device that includes or is coupled to one or more components configured to capture images. As other examples, camera device 420 may comprise any type of computing device such as a laptop computer, desktop computer, gaming console, or the like that includes or is coupled to one or more components configured to capture images.

Generally speaking, image capture module 421 may comprise any component, whether included within device 420 or external to device 420 configured to capture images. As shown in FIG. 4, image capture module includes a camera control module 460 and a camera element 462. Camera element 462 may comprise a CMOS image sensor or any other type of image sensor that is configured to capture one or more still or video images. Camera control module 460 may be configured to control camera element 462, as well as other components of camera device 420, to facilitate image capture using camera element 462.

As also shown in FIG. 4, SLID flash module 422 includes an LED control module 430 and an LED matrix 432. Generally speaking, LED control unit 430 may to generate one or more control signals to control LED matrix 432 to output light comprising a spatial intensity distribution controlled flash 424 consistent with one or more aspects of this disclosure. For example, SLID flash module 422 may generate such one or more control signals to control LED matrix 432, based on one or more signals received from camera control module 460, to illuminate one or more objects substantially simultaneously with operation of image capture module 421 (e.g., camera element 462) to capture one or more images.

As shown in the example of FIG. 4, camera device 420 may also include one or more processors 458 and/or one or more memory elements 454. Processor 458 may comprise one or more components configured to execute instructions to perform the various functionality described herein, and/or other functionality not described herein. For example, processor 458 may comprise one or more of a central programming unit (CPU), a microprocessor, a digital signal processor, a field programmable gate array (FPGA), an application specific integrated circuit (ASIC), or any other type of device configured to execute instructions. Memory element 454 may comprise one or more components configured to store data and/or instructions to be executed by processor 458. For example, memory element 454 may comprise one or more of random access memory (RAM), magnetic hard drive memory, read-only memory (ROM), flash memory, EEPROM memory, optical disc memory, or any other component configured to store data and/or executable instructions. Memory element 454 may, in some examples, be easily removable from camera device, such as a USB flash memory storage device, or a flash memory card. In other examples, memory element 454 may be internal memory of camera device 420 that is not easily removable by a user of device 420.

The various components of camera device 420 described herein, such as camera control module 460, LED control module 430, and other components may comprise at least in part one or more software applications executable by processor 458 to perform the respective functionality described herein. Such instructions executable by processor 458 may be stored in a memory component 454 of camera device (i.e., an internal or removeable memory device), or stored external to camera device and accessible via a network connection. In other examples, one or more components of camera device 420 may comprise one or more hardware components specifically configured to perform the respective functionality described herein. In still other examples, the various components described herein may comprise any combination of hardware, software, firmware, and/or any other component configured to operate according to the functionality described herein.

Camera control module 460 may operate various components of camera device 420 to capture one or more images. For example, camera control module 460 may receive one or more signals (e.g., via user input, from a software application executing on processor 458, and/or from external to device 420) that indicate that device 420 should be operated to capture one or more images. Camera control module 460 may, in response to such a received signal, operate one or more mechanical shutter mechanisms of camera device 420 to expose camera element 462, and substantially simultaneously operate SLID flash module 422 to output light to illuminate one or more objects to be captured as an image. SLID flash module 422 may illuminate the one or more objects using a spatial intensity distribution controlled flash 424. Once an image is captured by camera element 462, camera control module 460 may store a computer-readable representation of the captured image in a memory, such as memory 454 of camera device 420, or in a memory device or component communicatively coupled with camera device 420 (e.g., via a network).

According to some aspects of this disclosure, camera control module 460 may operate camera device 420 to detect one or more characteristics of an optical environment of camera device 420, and modify operation of one or more components of device 420 to improve a quality of captured images. For example, camera control module 460 may determine a level of ambient light in an environment of camera device 420. As one such example, camera control module 460 may operate camera element 462 (and/or other components of device 420) to capture a preliminary image, and based on the preliminary image determine a level of ambient light in the optical environment of device 420. As another example, as shown in FIG. 4, device 420 may include one or more ambient light sensors 456. According to this example, camera control module 460 may cause such one or more sensors 456 to detect a measurement of ambient light.

As another example, camera control module 460 may determine two or more objects of interest for image capture, and determine respective distances to the two or more objects to be captured as an image by camera device 420. For example, camera control module 460 may use facial recognition software, object recognition software, or user input to determine two or more objects of interest for image capture. Once the two or more objects of interest have been determined by camera control module 460, camera control module 460 may determine respective distances associated with the two or more objects.

For example, camera control module 460 may operate one or more sensors 456 of camera device 420 that are configured to determine respective distances to the one or more objects. For example, sensors 456 may include one or more time of flight sensors that are specifically configured to illuminate an object and determine a distance to the object based on how long it takes to detect light reflected from the object. In other examples, sensors 456 may include any type of sensor capable of determining an absolute or relative distance to one or more objects.

According to other examples, camera control module 460 may determine a distance to two or more objects using camera element 462. For example, camera control module 460 may illuminate an object and capture one or more preliminary image of the one or more objects, and use the preliminary images to determine a distance associated the object.

According to one such example, to determine a distance to a first object, camera control module 460 may generate one or more control signals that cause SLID flash module 422 to output two uniform pulses of light (two uniform flashes). Based on the two uniform pulses of light, camera control module 460 may determine a distance d1 to the first object.

The first uniform pulse of light may comprise flash with a relatively high intensity $I_{o_max}$. While the first uniform pulse of light is output by SLID flash module 422, camera control module 460 may cause camera element 462 to capture a first image that includes the first object. Camera control module 460 may process the first captured image to determine a first intensity value $I_{1_max}$ of light reflected by the first object in the first captured image. $I_{1_max}$ may relate to the distance $d_1$ to the first object according to the equation $I_{1_max}=I_{o_max}/d_1^2$.

The second uniform pulse of light may comprise a flash with a lower intensity $I_{o_low}$ than the intensity $I_{o_max}$ of the first uniform pulse of light. For example, the second uniform pulse of light may have an intensity of $I_{o_max}$ divided by a scaling factor a, $I_{o_max}/a$. The scaling factor a may have a value greater than one (1). While the second uniform pulse of light is output by SLID flash module 422, camera control module 460 may cause camera element 462 to capture a second image that includes the first object. Camera control module 460 may process the second captured image to determine a second intensity value $I_{1_low}$ of light reflected by the first object in the second captured image. $I_{1_low}$ may relate to a distance $d_1$ to the first object according to the equation $I_{1_low}=I_{o_low}/(ad_1^2)$.

Camera control module 460 may also determine a change in intensity value ΔI between the first intensity value $I_{1_max}$ and the second determined intensity value $I_{1_low}$ according to the equation $\Delta I=I_{1_max}-I_{1_low}=I_{o_max}/d_1^2-I_{o_max}/(ad_1^2)=(I_{o_max}/d_1^2)\times((a-1)/a)$. Using the determined change in intensity value ΔI, camera control module 460 may determine a distance d1 to the first object based on the equation $d_1=\sqrt{(I_{o_max}/\Delta I)}\times((a-1)/a)$.

Camera control module 460 may also determine a distance $d_2$ to a second object using the same technique as described above for the second object. For example, camera control module 460 may cause SLID flash module 422 to output two uniform pulses of light (two uniform flashes) directed to the second object. Based on the two uniform pulses of light, camera control module 460 may determine a distance $d_2$ to the second object.

The first uniform pulse of light may comprise flash with a relatively high intensity $I_{o_max}$. While the first uniform pulse of light is output by SLID flash module 422, camera control module 460 may cause camera element 462 to capture a first image that includes the second object. Camera control module 460 may process the first captured image that includes the second object to determine a first intensity value $I_{1_max}$ of light reflected by the first object in the first captured image. $I_{1_max}$ may relate to a distance $d_2$ to the second object according to the equation $I_{1_max}=I_{o_max}/d_2^2$.

The second uniform pulse of light may comprise a flash with a lower intensity $I_{o_low}$ than the intensity $I_{o_max}$ of the first uniform pulse of light. For example, the second uniform pulse of light may have an intensity of $I_{o_max}$ divided by a scaling factor a, $I_{o_max}/a$. The scaling factor a may have a value greater than one (1). The scaling factor a may be the same, or a different, scaling factor than the scaling factor a used to determine the distance $d_1$ to the first object as described above. While the second uniform pulse of light is output by SLID flash module 422, camera control module 460 may cause camera element 462 to capture a second image that includes the second object. Camera control module 460 may process the second captured image that includes the second object to determine a second intensity value $I_{1_low}$ of light reflected by the first object in the second captured image. $I_{1_low}$ may relate to a distance d1 to the first object according to the equation $I_{1_low}=I_{o_low}/(ad_1^2)$.

Camera control module 460 may also determine a change in intensity value ΔI between the first intensity value $I_{1_max}$ and the second determined intensity value $I_{1_low}$ according to the equation $\Delta I=I_{1_max}-I_{1_low}=I_{o_max}/d_2^2-I_{o_max}/(ad_2^2)=(I_{o_max}/d_2^2)\times((a-1)/a)$. Accordingly, camera control module 460 may determine a distance $d_2$ to the second object based on the equation $d_2=(I_{o_max}/\Delta I)\times((a-1)/a)$.

As described above, in some examples camera control module 460 may determine a distance $d_1$ associated with a first object to be captured in an image, and a distance $d_2$ associated with a second object to be captured in the image based on capturing preliminary images of two or more respective objects when illuminated with light of different intensities. In other examples, camera device 420 may use one or more other techniques to determine the distances $d_1$ and $d_2$ associated with the two or more objects using other techniques. For example, as described above, camera device 420 may include one or more sensors specifically configured to determine the distances $d_1$ and $d_2$ associated with the two or more objects. According to other examples, camera device 420 may utilize one or more image processing techniques other than those discussed herein to determine the distances $d_1$ and $d_2$ associated with the two or more objects.

Once camera control module 460 has determined the respective distances $d_1$ and $d_2$ associated with the two or more objects using the techniques described above or other techniques, camera control module 460 may used the determined distances $d_1$ and $d_2$ to generate a spatial light intensity distribution (SLID) map. The generated SLID map may indicate, for two or more respective LED elements of LED matrix 432, an intensity of light to be output by the two or more LED elements to illuminate the first and second objects during capture of an image. In this manner, camera device 420 may generate an SLID flash 424 with a controlled spatial intensity distribution, in order to improve illumination of both of the first and second objects, which may improve a quality of one or more images of the first and second objects captured by image capture module 421.

Figure 5:
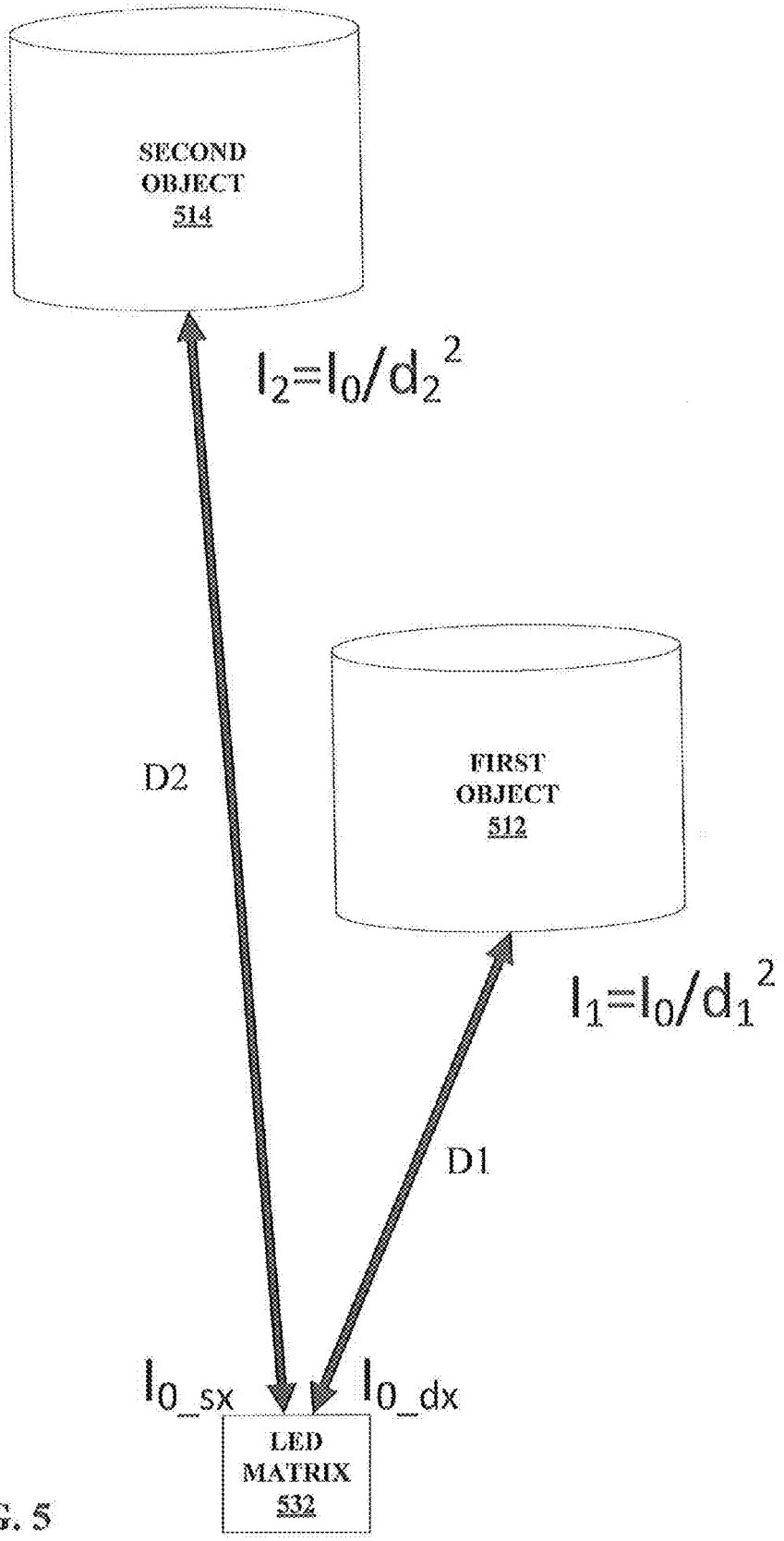
FIG. 5 is a conceptual diagram that illustrates one example of an LED matrix configured to illuminate a least two objects consistent with one or more aspects of this disclosure.

FIG. 5 is a conceptual diagram that illustrates one example of a technique for determining a spatial light intensity distribution (SLID) map that may be used to output a spatial light intensity distribution controlled flash consistent with one or more aspects of this disclosure. The determined SLID map may be used to control an LED matrix 532 to output light with a controlled spatial intensity distribution.

As discussed above, the SLID map may be generated to illuminate both first object 512 and second object 514, in order to improve a quality of an image representing the first object 512 located at a first distance d1 from LED matrix 532, and second object 514 which is located at a second distance d2 from LED matrix 532. According to the example of FIG. 5, the second distance d2 is greater than the first distance d1.

According to the example of FIG. 5, camera control module 460 may determine the SLID map to control a first plurality of LED elements of LED matrix 532 with a first intensity $I_{o_sx}$, and to control a second plurality of LED elements of LED matrix 532 with second intensity $I_{o_dx}$ different than the first intensity. In some examples, the first plurality of LED elements of the LED matrix 532 may correspond to a rightmost half of the LED elements of LED matrix 532 (e.g., LED elements 234I-234P of LED matrix 232 depicted in FIG. 2), and the second plurality of LED elements of the LED matrix 532 may correspond to a leftmost half of the LED elements of LED matrix 532 (e.g., LED elements 234A-234H depicted in FIG. 2). In other examples, the first and second plurality of LED elements may not correspond to symmetrical right and left groupings of LED elements, respectively, as shown in the example of FIG. 2. According to still other examples, the first and second plurality of LED elements may comprise any arrangement of LED elements of LED matrix 532, whether or not the respective arrangements are symmetrical or not.

According to the example of FIG. 5, $I_{o_dx}$ refers to an intensity of light output by the first plurality of LED elements (i.e., the rightmost plurality of LED elements), and the value $I_1$ refers to an intensity of light that reaches first object 112. Also according to the example of FIG. 5, $I_{o_sx}$ refers to an intensity of light output by the second plurality of LED elements (i.e., the leftmost plurality of LED elements), and the value $I_2$ refers to an intensity of light that reaches second object 514.

To determine an SLID map to illuminate first object 512 and second object 514 substantially simultaneously, camera control module 460 may first assign which of the first plurality of LED elements or the second plurality of LED elements that are associated with an object a greater distance away from LED matrix 532 with a relatively high intensity value. For example, as shown in FIG. 5, second object 514 is located at a distance d2 from LED matrix 532, which is greater than the distance d1 between first object 512 and LED matrix 532. According to the example of FIG. 5, the first (e.g., rightmost) plurality of LED elements may be associated with first object 512, while the second (e.g., leftmost) plurality of LED elements may be associated with second object 514. Accordingly, camera control module 460 may assign the second plurality of LED elements with a relatively high intensity value compared to an intensity value of the first plurality of LED elements, such as a maximum (e.g., 100 percent duty cycle) or near maximum (e.g., 90 percent duty cycle) value of light that may be output by the second plurality of LED elements.

Camera control module 460 may also determine an intensity value for the first plurality of LED elements which are associated with first object 512, which is located a distance d1 from LED matrix 532. To determine the intensity value for the first plurality of LED elements, camera control module 460 may select the intensity value such that the intensity I1 received at the first object 512 is substantially equal to the intensity I2 received at second object 514 (i.e. I1=I2). To do so, camera control module 460 may select the intensity value $I_{o_dx}$ such that the difference between I1 and I2 is substantially equal to zero according to the equation $\Delta I = I1 - I1 = I_{o_dx}/d_1^2 - lo_sx/(d_2^2) = 0$. For example, camera control module 460 may determine the intensity value associated with the first plurality of LED elements $I_{o_dx}$ based on the equation $I_{o_dx} = I_{o_sx}/(d2/d1)^2$.

As described above, camera device 420 may include one or more sensors configured to detect a level of ambient illumination and/or camera device may be configured to capture a preliminary image and determine a level of ambient illumination based on processing the preliminary image. In some examples, once the intensity values $I_{o_dx}$ and $I_{o_sx}$ have been determined by camera control module 460, camera control module 460 may also scale the determined intensity values based on a determined level of ambient light in the optical environment of camera device 420. According to one such example, if there is a greater level of ambient light in the optical environment, camera control module 460 may reduce the determined intensity values $I_{o_dx}$ and $I_{o_sx}$ by a scaling factor. According to another such example, if there is a lesser level of ambient light in the optical environment, camera control module 460 may increase the determined intensity values $I_{o_dx}$ and $I_{o_sx}$, by a scaling factor.

Once the respective intensity values $I_{o_dx}$ and $I_{o_sx}$ have been determined and/or scaled by camera control module 460, camera control module 460 may communicate them to LED control module 430. LED control module 430 may generate the SLID map, which indicates for each LED of LED matrix 532 a determined intensity value. As such, SLID flash module 422 may cause LED matrix 532 to output light with a controlled spatial intensity distribution, where at least a first LED element of LED matrix 532 (e.g., the first plurality of LED elements) outputs like of a first intensity (e.g., with an intensity value of $I_{o_dx}$), and at least a second LED element of the LED matrix 532 outputs light of a second intensity (e.g., with the intensity value $I_{o_sx}$) different than the first intensity. In this manner, SLID flash module 430 may illuminate both first object 112 and second object 114 substantially simultaneously, in order to improve a quality of one or more captured images, or for any other purpose where illumination of two or more objects is desirable.

The example of FIG. 4 describes techniques for illuminating two objects located at different distances from camera device 420 substantially simultaneously using an LED matrix 532. In other examples, these techniques may be applied to more than two objects located at different distances from one another. For example, camera device 420 may be configured to determine respective distances d1, d2, and d3 associated with three different objects, and apply the techniques described above to generate an SLID map that corresponds to three different groupings of LED elements of the LED matrix 532, such that each of the three groupings outputs light that corresponds to one of the three distances d1, d2, and d3. Likewise, the techniques described herein may be applied to any number of objects to be captured as an image.

Figure 6:
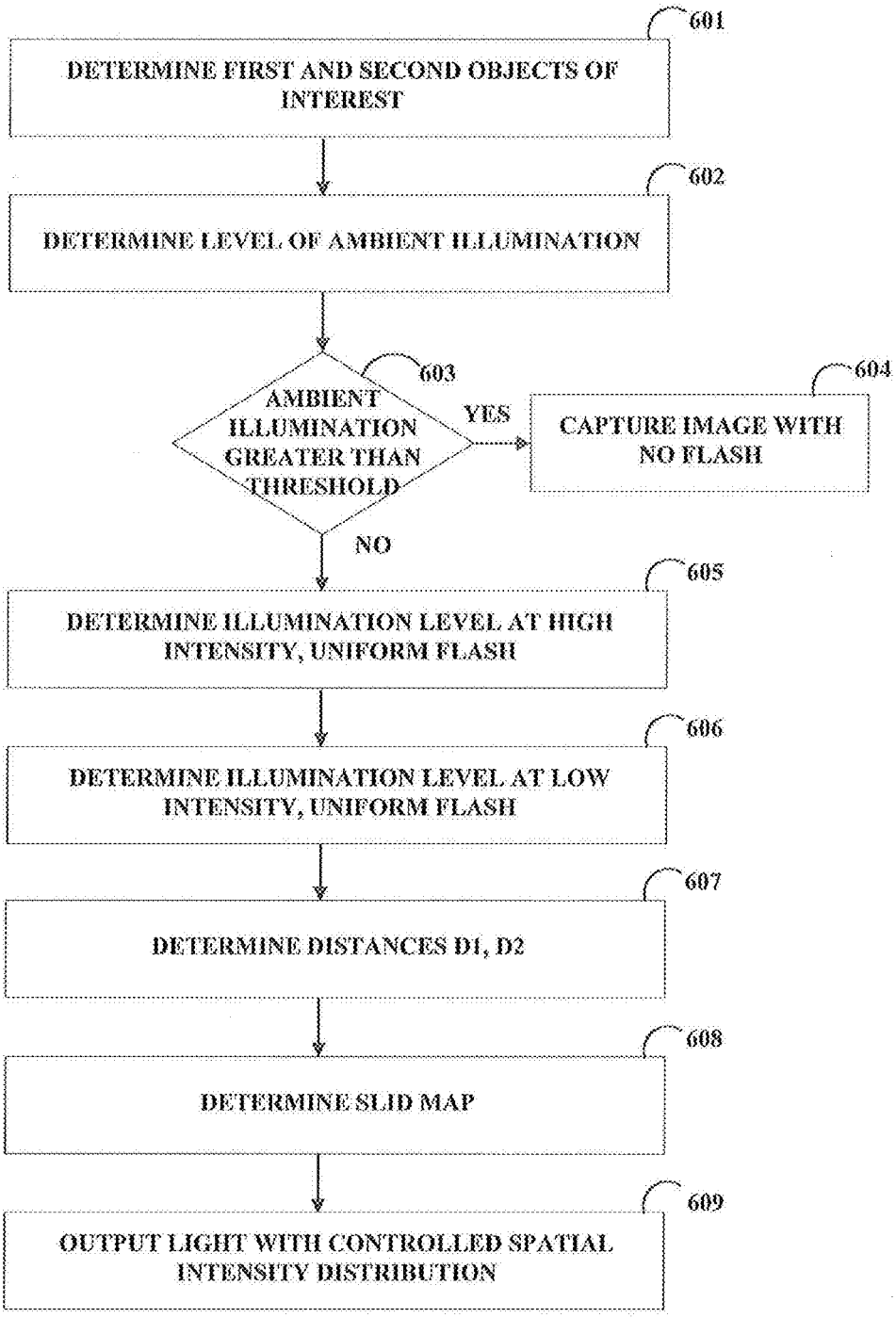
FIG. 6 is a flow diagram that illustrates one example of a method for illuminating two or more objects consistent with one or more aspects of this disclosure.

FIG. 6 is a flow diagram that illustrates one example of a method of illuminating two or more objects consistent with one or more aspects of this disclosure. As shown in FIG. 6, a camera device 420 determines a first object of interest 512 and a second object of interest 514 (601). For example, camera device 420 may determine first 512 and second 514 objects of interest based on object or facial recognition software that processes a preliminary image of the first and second objects. As another example, the camera device 420 may determine the first 512 and second 514 objects based on user input. For example, the camera device 420 may provide a user with a user interface (e.g., a touch screen interface, keyboard interface, voice command interface) or the like that allows the user to select the first 512 and second 514 objects.

As also shown in FIG. 6, camera device 420 may determine a level of ambient illumination in an optical environment of the camera device 420 (602). For example, camera device 420 may process a preliminary image of the optical environment taken with no additional illumination to determine a level of ambient illumination. As another example, camera device 420 may include one or more sensors 456 (e.g., ambient light sensors), which camera device 420 may use to determine a level of ambient illumination in the optical environment.

As also shown in FIG. 6, camera device 420 may compare the determined level of ambient illumination to a threshold (603). As also shown in FIG. 6, if the level of ambient illumination is greater than the threshold, camera device 420 may operate to capture an image without any additional illumination (604).

As also shown in FIG. 6, if the level of ambient illumination is less than the threshold, camera device 420 may determine an illumination level at a high intensity, with a uniform flash (605). For example, camera device 420 may operate SLID flash module 422 to output light directed to the first and second objects of interest 512, 514 with uniform light at a relatively high intensity while capturing a first image, and process the first image to determine a level at which the of the first and second objects 512, 514 are illuminated by the higher intensity light output by SLID flash module 422.

As also shown in FIG. 6, camera device 420 may determine an illumination level at a low intensity, with a uniform flash (606). For example, camera device 420 may operate SLID flash module 422 to output uniform light at a relatively low intensity (e.g., lower than the intensity of light output at 606) while capturing a second image, and process the second image to determine a level at which the of the first and second objects 512, 514 are illuminated by the lower intensity light output by SLID flash module 422.

As also shown in FIG. 6, camera device 420 may determine a first distance d1 to the first object 512, and determine a second distance d2 to the second object 514 (607). For example, as described above, camera device 420 may use the determined illumination intensity levels of the first object 512 and the second object 514 determined at steps 605 and 606 to determine the respective distances d1 and d2. According to other examples, camera device 420 may not perform steps 605 and 606, and instead determine the respective distances d1 and d2 using one or more sensors specifically configured to determine a distance to one or more objects. For example, camera device 420 may instead determine the respective distances d1 and d2 using a time of flight sensor configured to illuminate an object and determine a distance to the object based on how long it takes for light reflected from the object to return to the time of flight sensor. According to still other examples, camera device 420 may use one or more other image processing techniques to determine the respective distances d1 and d2 that are not described herein.

As also shown in FIG. 6, camera device 420 may determine an SLID map (608). The SLID map may indicate an intensity level associated with each LED element of an LED matrix. For example, camera device 420 may determine an intensity of light to be output (e.g., $I_{o_dx}$) by a first plurality of LED elements of an LED matrix to illuminate first object 412 at the first distance d1, and also determine an intensity of light to be output (e.g., $I_{o_dx}$) by a second plurality of LED elements of the LED matrix to illuminate second object 414 at the second distance d2. In some examples, camera device 420 may determine the respective intensities such that first object 412 receives light of a substantially similar intensity as an intensity of light received by second object 414.

As also shown in FIG. 6, camera device 420 may output a light with a controlled spatial intensity distribution (609). For example, based on the determined SLID map, camera device 420 may cause at least a first LED element (e.g., a first plurality of LED elements) of LED matrix 532 to output light of a first intensity (e.g., intensity $I_{o_dx}$), and to cause at least a second LED element (e.g., a second plurality of LED elements) of LED matrix 532 to output light of a second intensity (e.g., intensity $I_{o_sx}$) different than the first intensity.

In some examples, the method described above with respect to FIG. 6 may be advantageously used to illuminate two or more objects substantially simultaneously, in order to improve a consistency of illumination of the two or more objects. Such techniques may be beneficial in a variety of applications, for example a camera device as described herein may output light with a controlled spatial intensity distribution along with operating the device to capture one or more images, to improve a quality of the captured one or more images. According to other examples, such techniques may be used for any other application where illumination of an object is desired, such as interior or exterior lighting, motor vehicle lighting, bicycle lighting, boat lighting, aircraft lighting, or any other application where illumination of two or more objects is desirable.

Figure 7:
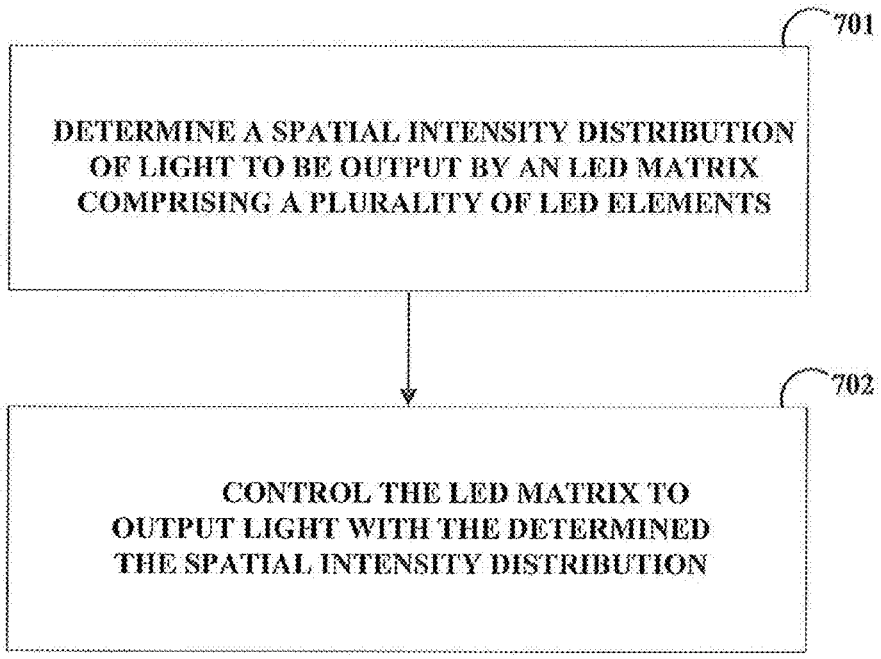
FIG. 7 is a flow diagram that illustrates one example of a method of outputting light with a controlled spatial intensity distribution consistent with one or more aspects of this disclosure.

FIG. 7 is a flow diagram that illustrates one example of a method of illuminating one or more objects consistent with one or more aspects of this disclosure. As shown in FIG. 7, a camera device 120 may determine a spatial intensity distribution of light to be output via an LED matrix 232 comprising a plurality of LED elements 237 (701). For example, as described above, camera device 120 may determine two or more objects of interest for image capture via one or more image sensors of camera device 120. Camera device 120 may also determine a relative or actual distance from camera device 120 to each of the two or more objects. Based on determined relative distances, camera device 120 may determine an SLID map 239, which may indicate an intensity level of light to be output by one or more LED element 234A-234P of the LED matrix 232. In some examples, camera device 120 may determine the SLID map 239 such that at least one LED element of the LED matrix 232 outputs light of a first intensity level, and such that at least one second LED element of the LED matrix 232 outputs light of a second intensity level different than the first intensity level.

As also shown in FIG. 7, camera device 120 may also control LED matrix 232 to output light with the determined spatial intensity distribution. For example, as described above with respect to FIG. 3, camera device 220 (e.g., LED control module 230) may send an SLID map 239 as described above to one or more LED driver modules 237. In response to the respective intensity values indicated in the SLID map 239, LED driver module 237 may generate one or more drive signals with a current level selected to cause the respective LED elements 234A-234H to output light of the indicated intensity levels. According to some examples, each respective drive signal may have a current (e.g., duty cycle) configured to cause the respective LED element 234A-234H to output light of a desired intensity level. In this manner, at least one LED element 234A-234H of LED matrix 232 may be controlled to output light of a different intensity than at least one other LED element 234A-234H of LED matrix 232.

Using the techniques described above with respect to FIG. 7, a camera device 120 may generate a camera flash with a desired spatial light intensity distribution. As described above, such a camera flash may be output substantially simultaneously with operation of the camera device 120 to capture an image that includes first and second objects, to improve a quality of captured images.

In one or more examples, the functions described herein may be implemented at least partially in hardware, such as specific hardware components or a processor. More generally, the techniques may be implemented in hardware, processors, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium, i.e., a computer-readable transmission medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transient media, but are instead directed to non-transient, tangible storage media. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

Instructions may be executed by one or more processors, such as one or more central processing units (CPU), digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various examples been described. These and other examples are within the scope of the following claims.

The invention claimed is:

1. A camera device, comprising:

a flash module that includes an LED matrix comprising a plurality of LED elements; and an LED control unit that:

determines a spatial intensity distribution of light to be output by the LED matrix; and controls the LED matrix to output light with the determined spatial intensity distribution in a substantially instantaneous burst of light to illuminate one or more objects by causing at least a first LED element of the LED matrix to output light of a first intensity, and causing at least a second LED element of the LED matrix to output light of a second intensity different than the first intensity, wherein:

the device determines a first distance between the device and a first object to be captured in an image and a second distance between the device and a second object to be captured in the image; and in response to the device determining the first and second distances, the LED control unit causes at least a first LED element of the LED matrix to output the light of the first intensity to illuminate the first object at a first location at the first distance from the device, wherein the LED control unit causes at least a second LED element of the LED matrix to output light of a second intensity to illuminate the second object at a second location different than the first location at the second distance from the device, and wherein the light from at least the first LED element illuminates the first object at the first location simultaneously with the light from at least the second LED element illuminating the second object at the second location.

2. The device of claim 1, further comprising:

at least one sensor module configured to detect at least one optical characteristic;

wherein the LED control unit controls the LED matrix to output the light with the determined spatial intensity distribution based on the at least one detected optical characteristic.

3. The device of claim 2, wherein the at least one sensor module comprises at least one image sensor configured to capture one or more images of at least one object.

4. The device of claim 3, wherein the LED control unit controls the LED matrix to output light with the determined spatial intensity distribution to illuminate the at least one object when the image sensor module is operated to capture the one or more images of the at least one object.

5. The device of claim 2, wherein the at least one optical characteristic detected by the sensor module comprises a relative location between the at least one image sensor and the at least one object.

6. The device of claim 2, wherein the LED control unit is configured to, in response to the at least one detected optical characteristic, control at least the first LED element of the LED matrix to illuminate the first object, and to control at least the second LED element of the LED matrix to illuminate the second object different than the first object.

7. A method, comprising:

determining a spatial intensity distribution of light to be output by flash module that includes an LED matrix comprising a plurality of LED elements; and controlling the LED matrix to output light with the determined spatial intensity distribution to illuminate one or more objects in a substantially instantaneous burst of light, wherein controlling the LED matrix to output light includes:

causing at least a first LED element of the LED matrix to output light of a first intensity;

causing at least a second LED element of the LED matrix to output light of a second intensity different than the first intensity;

determining a first distance between the device and a first object to be captured in an image and a second distance between the device and a second object to be captured in the image;

controlling the at least a first LED element of the LED matrix to output the light of the first intensity to illuminate the first object at a first location at the first distance from the device;

controlling the at least a second LED element of the LED matrix to output the light of the second intensity to illuminate the second object at a second location different than the first location at the second distance from the device; and illuminating the first object at the first location from at least the first LED element and simultaneously illuminating the second object at the second location from at least the second LED element.

8. The method of claim 7, further comprising:

using at least one sensor module configured to detect at least one optical characteristic; and controlling the LED matrix to output light with the determined spatial intensity distribution based on the at least one detected optical characteristic.

9. The method of claim 8, wherein using the at least one sensor module comprises using an image sensor to capture one or more images of at least one object.

10. The method of claim 9, further comprising:

controlling the light output by the plurality of LED elements of the LED matrix to illuminate the at least one object when the image sensor module is operated to capture the one or more images of the at least one object.

11. The method of claim 8, wherein the at least one optical characteristic detected by the sensor module comprises a relative location between the at least one image sensor and the at least one object.

12. A device, comprising:

means for determining a spatial intensity distribution of light to be output by an LED matrix comprising a plurality of LED elements; and means for controlling the LED matrix to output light with the determined spatial intensity distribution wherein the means for controlling the LED matrix to output light includes:

means for causing at least a first LED element of the LED matrix to output light of a first intensity;

means for causing at least a second LED element of the LED matrix to output light of a second intensity different than the first intensity;

means for determining a first distance between the device and a first object to be captured in an image and a second distance between the device and a second object to be captured in the image;

means for controlling the at least a first LED element of the LED matrix to output the light of the first intensity to illuminate the first object at a first location at the first distance from the device;

means for controlling the at least a second LED element of the LED matrix to output the light of the second intensity to illuminate the second object at a second location different than the first location at the second distance from the device; and means for illuminating the first object at the first location from at least the first LED element and simultaneously illuminating the second object at the second location from at least the second LED element.

13. The device of claim 1, wherein the LED matrix is a monolithic, integrated semiconductor device.

* * * * *